United States Patent [19]

Andrei-Alexandru et al.

[11] Patent Number: 4,876,909

[45] Date of Patent: Oct. 31, 1989

[54] VEHICLE DOOR LOCKING SYSTEM

[75] Inventors: Marcel Andrei-Alexandru, Bietigheim-Bissingen; Heiner Bayha, Sersheim; Rainer Bruhn; Iris Maier, both of Bietigheim-Bissingen, all of Fed. Rep. of Germany

[73] Assignee: SWF Auto-Electric GmbH, Bietigheim-Bissingen, Fed. Rep. of Germany

[21] Appl. No.: 208,357

[22] PCT Filed: Aug. 1, 1987

[86] PCT No.: PCT/EP87/00424

§ 371 Date: Apr. 14, 1988

§ 102(e) Date: Apr. 14, 1988

[87] PCT Pub. No.: WO88/01334

PCT Pub. Date: Feb. 25, 1988

[30] Foreign Application Priority Data

Aug. 16, 1987 [DE] Fed. Rep. of Germany ..... 3627893

[51] Int. Cl.[4] ..... E05B 65/12; E05B 47/00

[52] U.S. Cl. ..... 74/411.5; 74/50

[58] Field of Search ..... 292/201, 336.5; 74/50, 74/411.5

[56] References Cited

U.S. PATENT DOCUMENTS

| | | | |
|---|---|---|---|
| 3,243,216 | 3/1966 | Peters | 292/201 |
| 4,461,501 | 7/1984 | Dumbser | 292/201 |
| 4,674,781 | 6/1987 | Reece et al. | 292/201 |
| 4,685,709 | 8/1987 | Kambic | 292/201 |

*Primary Examiner*—Peter A. Aschenbrenner
*Attorney, Agent, or Firm*—Robert P. Seitter

[57] ABSTRACT

An adjusting device for a door locking system of motor vehicles is described which prevents, by means of a mechanical brake device, the motor after being switched off from further running. Before an adjusting process is started, this brake device simultaneously checks if the adjusting force of the motor is sufficient to actuate the driven element. Moreover, a coupling is realized in the power transmission path by means of a crank pin axially movable.

By taking these measures operational and functional reliability is substantially improved.

5 Claims, 11 Drawing Sheets

VEHICLE DOOR LOCKING SYSTEM

The invention relates to a motor vehicle door locking system which may be actuated either manually or by electrical power.

A door locking system of this type is disclosed in U.S. Pat. No. 3,243,216. In contrast to other known devices, the locking device of U.S. Pat. No. 3,243,216 has the advantage that in the end positions the driven element is completely decoupled from the driving motor so that the driven element can easily be adjusted by hand. A further advantage is that relatively little control is required with respect to the driving motor only rotating in one direction. However, this known system according to the U.S. Pat. No. 3,243,216 does not meet all requirements with regard to operational reliability. In case of failure the crank might stop outside its parkingn position so that then the lack actuating slide cannot be adjusted any longer. Especially in case of over-voltage and of a mechanism that can easily adjusted, the crank—in dependence of the moment of inertia of the rotating parts—can go beyond the area of the parking position after switching off the driving motor and it may even shift the slide into the opposite direction. So the effective stroke is reduced and the manual adjustment of the driven element is blocked. On the other hand, in case of under-voltage the adjusting force of the motor is often insufficient to produce the necessary actuating force for the slide and for the adjusting member actuated by the adjusting device respectively. In such a case the motor is blocked, whereby the crank is also stopped outside the normal parking position.

In the prior art the slide is coupled with the push rod via an overload spring which enables the push rod to be adjusted from one oend position to the other even then, when the adjusting movement of the slide is blocked. This requires, however, a considerable amount of power, for the overload spring must be constructed in such a way that it can transfer the adjusting force normally necessary for the driven element. In most cases the push rod is operatively connected with the door lock of the motor vehicle and as it is known by experience, in such a case the door lock cannot be unlocked any longer by key.

Therefore the object of the present invention is to improve an adjusting device of the first-mentioned kindn by simplest means as to operational reliability and function and to simplify the construction.

The present invention is based on the ideaa that the cases of failure mentioned above can efficiently be avoided, if, by means of a brake device, it is ensured that the crank is stopped in a predetermined parking position after each adjusting process. This can be realized in a simple way of construction by a mechanical brake device which is spring biassed with a predetermined brake force against a brake area of an element acting in combination with the driving motor. This brake devise is easily controlled by a brake actuating or releasing is integrally formed with the crank. thus the functional reliability of the adjusting device can essentially be improved by only two additional structual elements, namely by a brake block and a spring element. What matters thereby, is that the brake force is exactly preadjusted to a given value by a spring element and that it does not depend on other influencing factors, for instance, on the speed of rotation of the crank.

According to a particularly preferred development this brake device shall fulfill another function. It ensures that the driving motor can drive the crank from its parking position only if the drive motor can overcome the brake force. This assures that if the battery energizing the motor is low, the crank will not be moved through only a partial strokeif there is sufficient power to overcome the brake force, there is sufficient power to drive the crank through a full stroke.

An additional coupling makes sure that in every position of othe crank the slide can easily be adjusted after using a force for only a short time. Thereby a construction is preferred comprising an additional coupling that is more or less integrated into the toothed wheel thus taking over another function at low costs. For controlling the adjusting device a switch disc has been fixed to this toothed wheel so far, which switch disc acts in combination with several stationary contact springs. A bridging contact was attached to the slide or the push rod, which bridging contact also acted in combination with separate counter contacts fixed within the housing. Such a construction takes a lot of work and time as to its assembly.

For the purpose of simplifying such a construction an embodiment comprising a bridging contact is springily supported and integrated into the toothed wheel which acts in combination with contact segments punched out of a blank and fixed as a whole within the housing. Being a carrier of a springily supported bridging contact the toothed wheel takes over a further function. For such an embodiment indepenent protection is also claimed because regardless of the concrete development of the brake device or of the additional coupling the costs are tremendously reduced, in particular if leads are clamped onto deflected connecting clips without any soldering or welding connections.

The invention and preferred embodiments according to the invention are illustrated in the following drawings in which.

Figure 18:
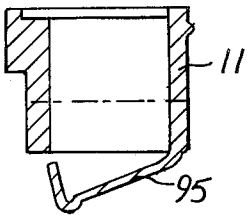
Figure 17:
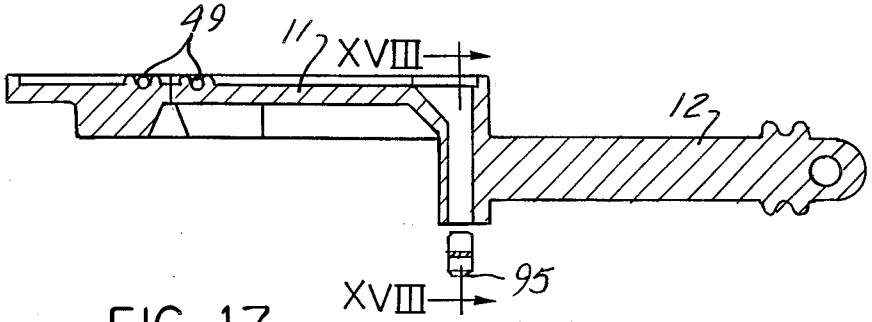
Figure 14:
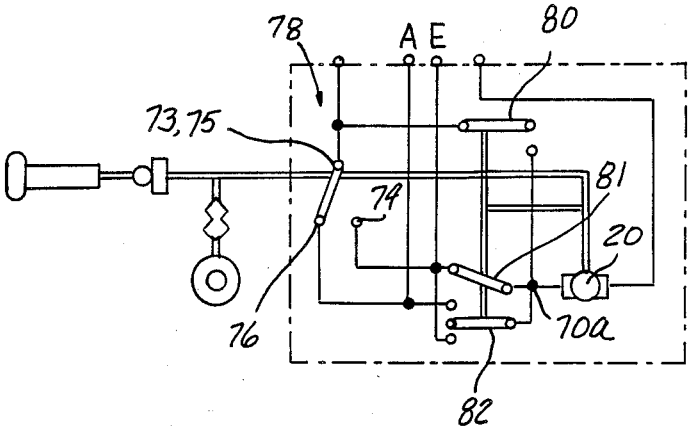
Figure 15:
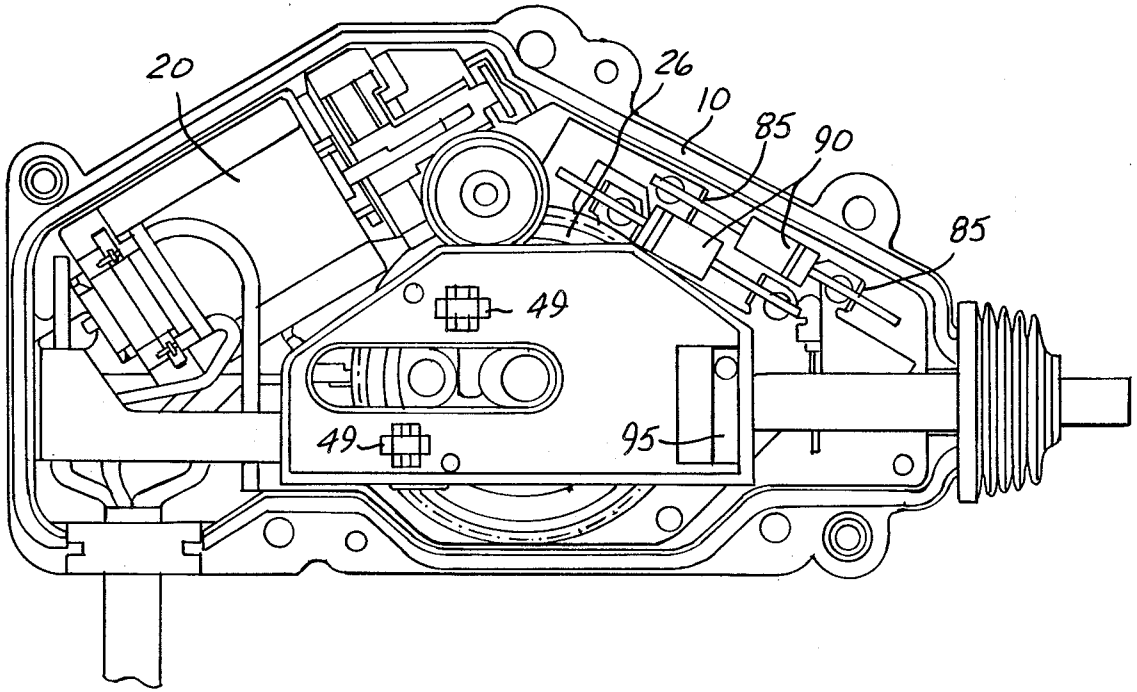
Figure 16:
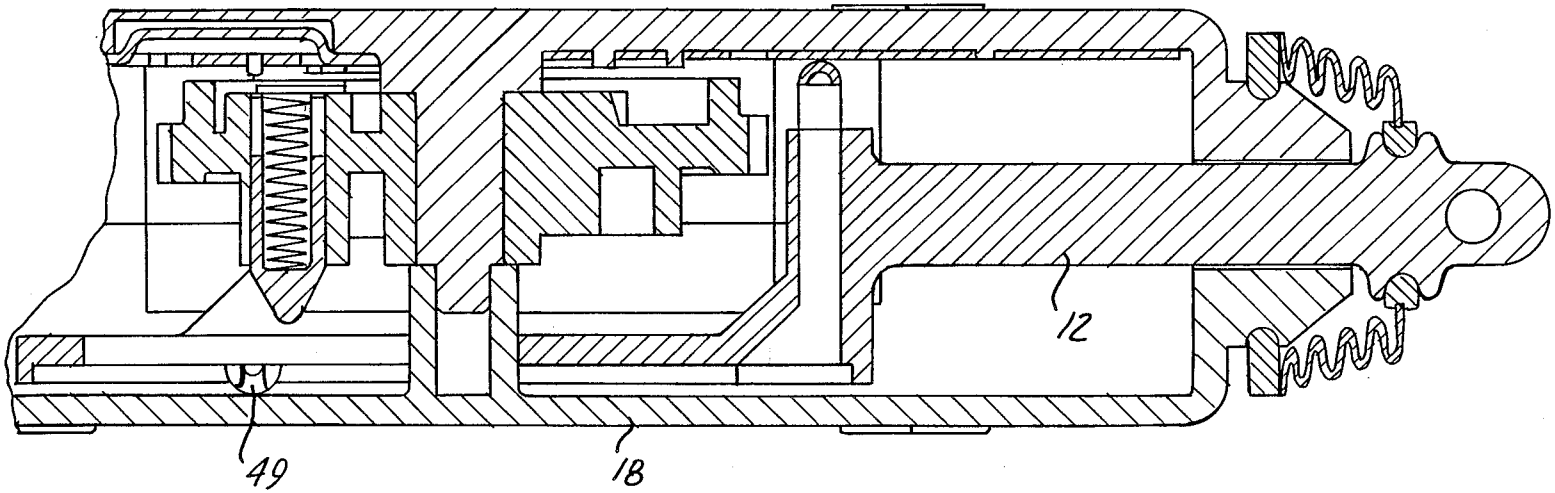
Figure 19:
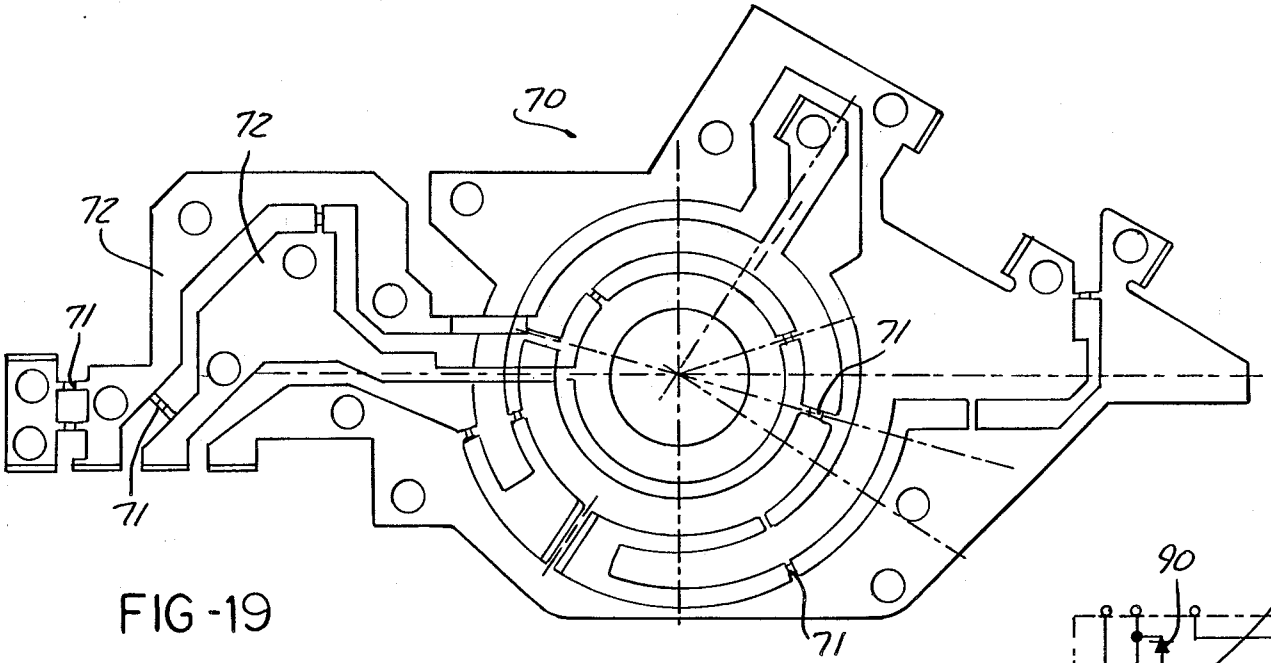
Figure 20:
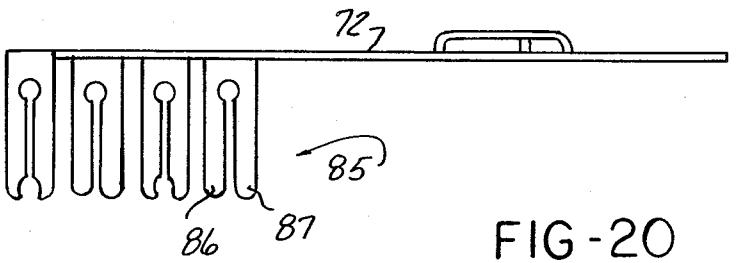
Figure 21:
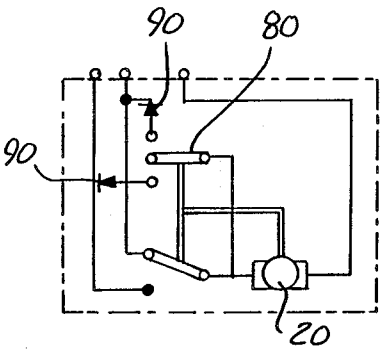
Figure 22:
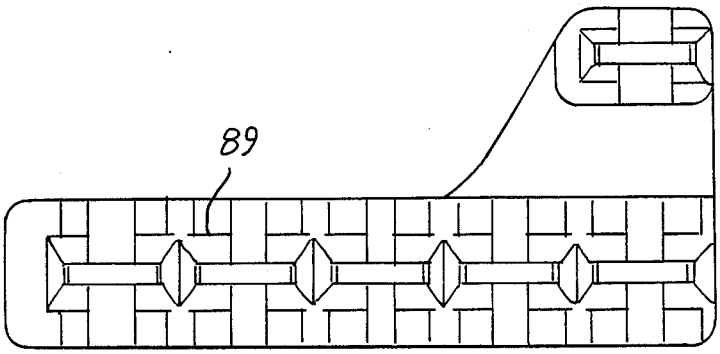
Figure 23:
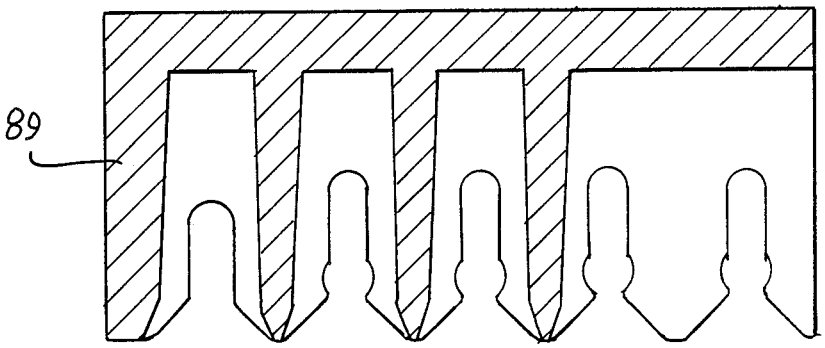

FIG. 14 is a circuit diagram for this first embodiment of an adjusting device, FIG. 15 is a view of a second embodiment of an adjusting device, FIG. 16 is a longitudinal section of this second embodiment, FIG. 17 is a longitudinal section ot the push rod and of othe slide, FIG. 18 is a cross section taken along the line XVIII—XVIII, FIG. 19 is a view of the blank, FIG. 20 is a partial section of the blank, FIG. 21 is a circuit diagram of the second embodiment, FIG. 22 is a view of a plug-and-socket connectoro and FIG. 23 is a longitudinal section of this plug-and socket connector.

First of all, by means of FIG. 1 the principal functions of device of the present invention are schematically illustrated. In a housing 10 a slide 11 is longitudinally guided. This slide 11 is operataively cononected to a push rod 12 which actuates a ddoor locking mechanism of a motor ovehicle as the driven element of the lock actuating device in a way that is well known (see U.S. Pat. No. 3,243,216) and is thus not shown in detail. Slide 11 is provided with two stops 13 and 14 which are fixedly mounted on the slide and cooperate with pin 15 of a crank 16 mounted for rotation abou a fixed axis M. FIG. 1 shows that distance A betwen the two stops 13 and 14 in the adjusting direction of slide 11 is smaller than the radius of the crank, i.e. it is smaller than the distance between pin 15 and the axis of rotatio nM. THus while prdetermining a certain radius of othe crank a big stroke of slide 11 is made sure. Distance B between the two stops 13 and 14 traversely measured to teh adjusting position of slide 11 is greater than the diameter of crank pin 15. In the parking positions crank pin 15 is inthe middle between the adjusting paths of the two stops 13 and 14. In this parking position slide 11 is completely decoupled from pin 15 and crank 16 respectively, and slide 11 including push rod 12 can easily be shited by hand from one end position to the other by manual actuation of the conventional garnish locking rod (See U.S. No. Pat. 3,243,216).

If the electric motor driving crank pin 15 is switched on, the crank pin is driven clockwise along its rotary path until it touches stop 14. Afterwards, during the rotary movement of this crank pin 15 both stop 14 and slide 11 are carried along until the crank pin reaches the parked position according to FIG. 1*b* aafter being rotated through an angle of 180 degrees. When stopped crank pin 15 is positioned midway between the paths of movement of the two stops 13 and 14. So in this other parking position the driving motor is completely decoupled from slide 11 so that the slide 11 may be manually reciprocated without interference between crank 15 and stops 13.

Figure 1A:
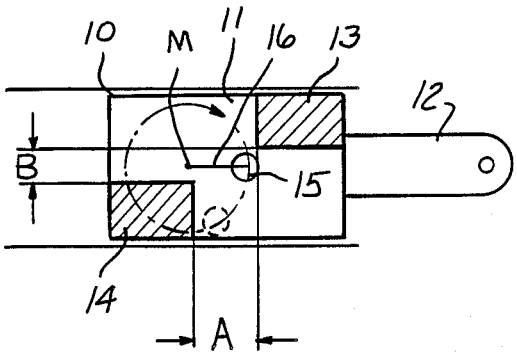
FIG. 1 is a diagrammatic view of an adjusting device.
Figure 1B:
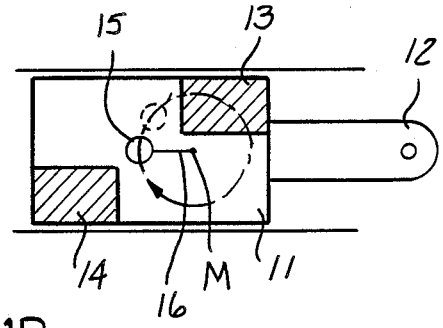

To sum it up, FIG. 1a and 1b show that crank pin 15—during each adjusting process—is driven through a rotary angle of 180 degree in the same direction of rotation. During one adjusting process one stop is moved out of the orbit of the crank pin, whereas the other stop is driven into the orbit of the crank pin. Crank pin 15 is only coupled with the stops 13 or 14 for a certain part of the rotary movement. In the parking position, however, after being rotated around an angle of 180 degrees each, the crank pin and slide 11 are decoupled form each other.

If such an adjusting device is actuated during overvoltage, it may happen that crank pin 15 goes beyond its normal parking position and it occupies, for instance, the position illustrated in FIG. 1*b* in broken lines. During under-voltage it may happen that crank pin 15 is pushed against stop 14, but due to an adjusting force that is too small, it cannot move slide 11. In this position of the crank pin represented in FIG. 1*a* in broken lines the slide cannot be moved any longer either. So in case of failure the door couldn't be unlocked any more. Such problems shall be solved by means ofo the present invention.

Usually a central door locking system of a motor vehicle comprises several adjusting devices, whereby at least one adjusting device is formed as a control unit, via which the other adjusting devices are controllable. Such a control unit is represented in FIGS. 2 to 14. However, FIGS. 15 to 21 show an adjusting device that does not comprise a control switch for controlling other adjusting devices. According to the drawings and the following description both embodiments with respect to their essential features are more or less identically constructed.

Figure 2:
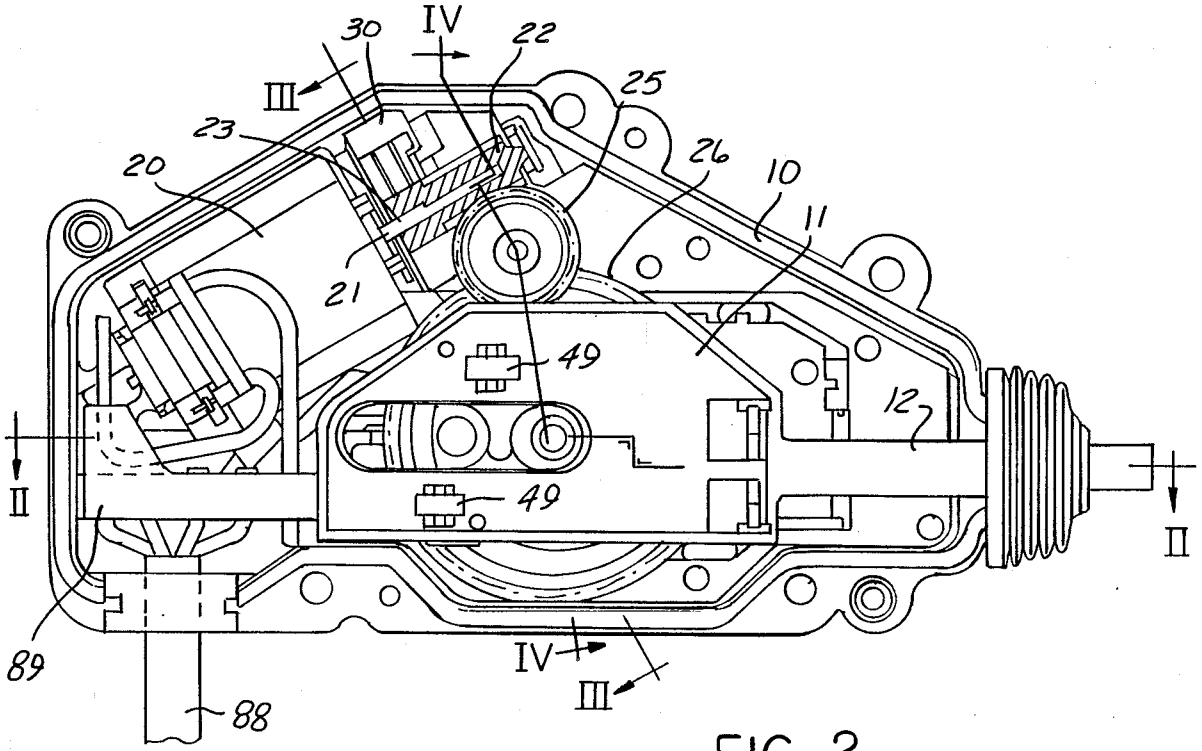
FIG. 2 is a view of a first embodiment of an adjusting device.

In FIG. 2 an electric motor is designated by 20. This electric motor serves as a driving motor for the adjusting device. On the drive shaft 21 of this electric motor a worm 22 protected against twisting is fixed, which—near the electric motor—comprises a cylindrical part 23 without a thread, which outer surface of said cylindrical part serves as a brake area 24 whose function will be described later on. Worm 22 drives a toothed wheel 26 via an intermediate wheel 25 which toothed wheel 26 is illustrated more precisely in FIGS. 6 to 9. Crank pin 15 is excentrically extending the one front face 27 of this toothed wheel 26. Crank pin 15 cooperates with stops 13, 14 of slide 11. This toothed wheel 26 together with crank pin 15 from crank 16 mentioned in FIG. 1

Figure 4:
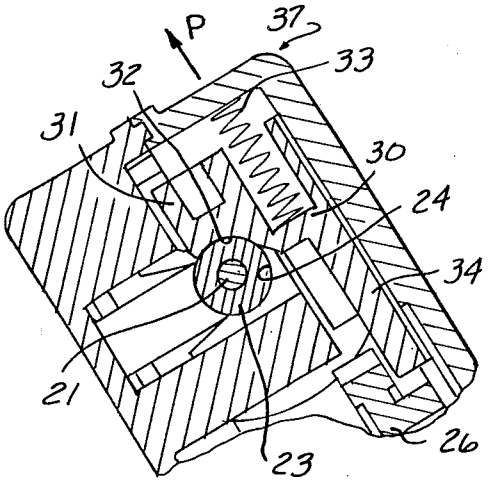
FIG. 4 is a partial section taken along the line III—III.
Figure 5:
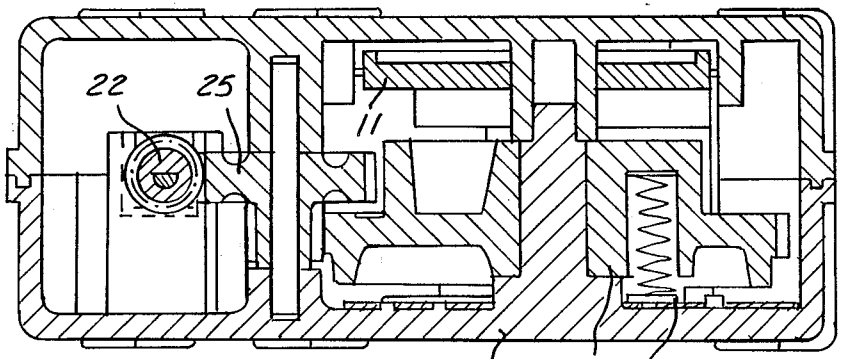
FIG. 5 is a section taken along the line IV—IV.

In the housing 10 a brake block 30 is swivellably guided in traverse direction to the axis of rotation of worm 22, which brake block—as it can be seen in FIG. 4—has a L-shaped cross-section. Th eshorter side 31 comprises a brake area 32 whose contour is adapted to the brake area 24 of the cylindrical part 23 of worm 22. A pressure spring 33 supported on a wall of the housing presses this brake block 30 with its brake area of the one side onto the brake area 24 of worm 22. The longer side of brake block 30 serves as a switching tappet 34 for shifting brake block 30. This switching tappet projects into the operating area of a switch cam 35 on the opposite side of the brake area 32, which switch cam is integrally mounted onto toothed wheel 26 as a circumferential collar, that is, said switch cam is operatively connected with the crank. This switch cam 35 can best be seen in FIG. 6. On the sides that are diametrically positioned this switch cam has a section 36 each which is radially back-positioned to such an extent that in this section a contact is no longer possible between the switch cam and switch tappet 34 of brake block 30. These recessed sections are in a angle area W, determining both parking positions of toothed wheel 26 aand crank 16 respectively.

From these explanations the following conclusions can be drawn:

In the parking positions brake block 30 being part of a brake device 37 is not affected by switch cam 35. So brake area 32 of the brake block is pressed against brake area 24 of worm 22 by a predetermined brake force substantially depending on the force of pressure spring 33, thus generally speaking, break area 32 is pressed against an element acting in combination with the electric motor. If the electric motor is switched on and if its adjusting force exceeds a certain value, toothed wheel 26 as well as switch cam 35 start rotating so that after a short angle of rotation, i.e. outside the parking position, crank pin 15 is pushed against a stop 13, 14 and simultaneously switch tappet 34 is adjusted in the direction of arrow P via switch cam 35. Then the two brake areas 24 and 32 do not touch each other any longer and the whole torque of the electric motor is used for adjusting the slide. As soon asa toothed wheel 26 reaches an angle of rotation of nearly 180 degree, switch tappet 34 can again enter section 36 of switch cam 35 which is in a back position and both brake areas 24 and 32 touch each other again. By cooperataion of the brake areas 24 and 32 of worm 22 and brake block 30 respectively a mechanical brake device 37 is realized which stops toothed wheel 26 and crank 16 in a predetermined angle area W after each adjusting process. However, outside this angle area the brake device is released.

What matters thereby is, that a certain brake force is given. This brake force depends on the stiffness of pressure spring 33, on the size of the brake areas 24 and 32 as well as on the nature of their surfaces. In a concrete embodiment the brake areas are provided with a surface as smooth as possible and furthermore there is lubricant between the brake areas. Using these means the wearing-out of the brake areas of the worm usually made of plastics and of the brake block also made of plastics as well as noises during the operation can be reduced, whereby nevertheless a sufficient brake force can be realized by using a relatively small spring force. Taking these conditions into consideration the brake force was adjusted in such a way that the motor can only start runnning, if its adjusting force exceeds a minimum value which is sufficient to fully adjust the slide, or in the casea mentioned, to adjust the door lock, even under the most favourable conditions. During under-voltage the brake force of this mechanical brake device cannot be overcome so that the crank does not get out of the parking position either and could thus block a manual adjustment of the slide. A brake device comprising these features fulfills two functions. It makes certain that the crank is stopped exactly in the parking positions and is thus prevented from further turning. On the other hand, the brake device checks at the beginning of each adjusting process, if the adjusting force of the electric motor corresponds to the predetermined values. Only in this case an adjusting process can be started at all. Due to this double function of the controlled mechanical brake device the operational reliability of othe adjusting device is substantially improved. If, for instance, the adjusting path of the slide should be blocked because of unavoidable tolerances in the closing mechanism or because of other disturbances, the means mentioned do not suffice. In some applications the adjusting path of the slide is deliberately made longer than the desired adjusting path of the driven element, as for example of the lock, so hat in the movement transmission linkage, even in case ofo unfavourable tolerances it is ensured that the driven element can perfectly be shited over. For incresaing security ha sprng-loaded coupling 40 that is only released in case of failure is installed into the power transmission path between the motor and the slide. This coupling is realized by adjustably guiding crank pin 15 on toothed wheel 26. For this purpose toothed wheel 26 has a complete bore 41 in parallel direction to the axis of rotation D in which bore this crank pin 15 is movably guided. This bore 41 is closed off on the side of the front face 28 by a supporting plate 42 by which a pressure spring 43 used as a spring element is supported, which pressure spring presses the crank pin 15 into the path of motion of the stops 13, 14. Supporting plate 42 has two sides 44 perpendicularly extending and comprising a lockig lug 45 each which project into guide slots 46 of the toothed wheel 26 and which act behind a stop 47 each and which thus determine the supporting plate of the toothed wheel to the direction of the axis. Such a construction meets all requirements with respect to stability whereby no more structural space nor a thicker toothed wheel in particular are needed.

This coupling 40 ensures that, even if slide 11 is hard to move or is blocked, toothed wheel 26 is rotated into its parking position nevertheless. Thereby contrary to the force of pressure spring 43 crank pin 15 is axially moved in the direction of arrow R and so it is not lying any longer in the path of motion of these stops 13, 14, so that the slide can easily be adjusted by hand. Especially when—according to FIG. 3—the adjusting path of crank pin 15 by means of stops is limited in such a way that its front face is not lying on slide 11. If due to voltage failure the crank pin is lying in the path of motion of a stop, this crank pin can be readjusted by manually adjusting the slide and so the slide can also be adjusted. If the adjusting path of the slide is longer than the adjusting path of the driven element, the coupling is released during each adjusting process. As soon as the crank pin is behind the stop, the slide can easily be adjusted by hand at least in one adjusting direction.

Figure 3:
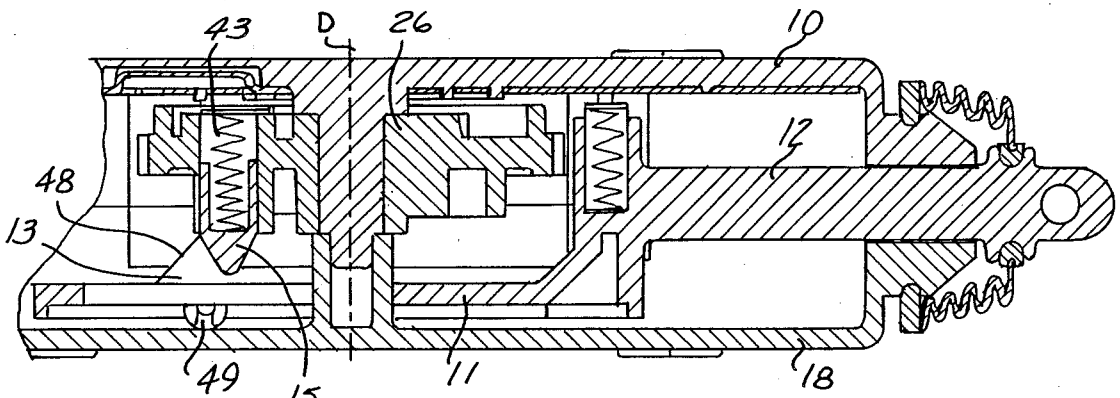
FIG. 3 is a section taken along the line II—II.
Figure 7:
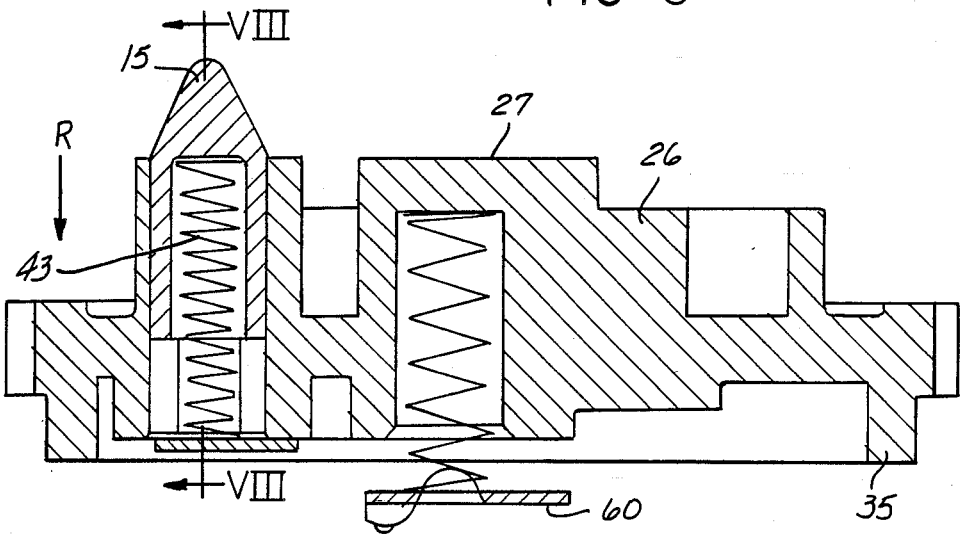
FIG. 7 is a section taken along the line VII—VII.
Figure 8:
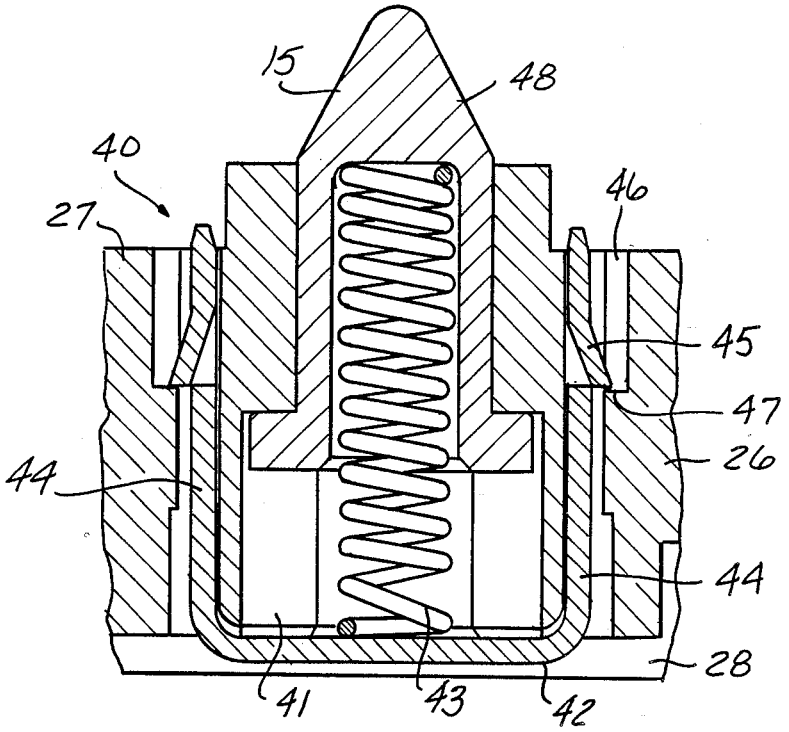
FIG. 8 is a partial section taken along the line VIII—VIII.

FIGS. 7 and 8 in particular, as well as FIG. 3 show that the adjustable crank pin 15 and the stops 13, 14 are provided with slanting roll-on areas 48 which shall enable the coupling 40 to be released without heaving. Because of this formation it is to be estimated that forces act upon slide 11 in transverse direction to the adjustment. These forces shall be cushioned via casters 49, which are rolling along a lid 18 closing the housing 10. Moreover, by means of slanting roll-on areas on both sides of the crank pin it is ensured that in case of a wrong polarity of the electric motor and thus of a direction of rotation different from that during the normal operation the motor is not blocked or damaged. The conical form of the crank pin guarantees a constant power transmission to the slide regardless of the angle of rotation.

Figure 10:
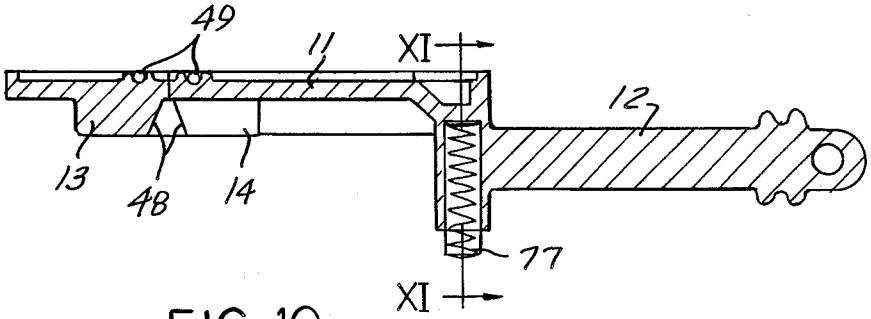
FIG. 10 is a longitudinal section of the push rod and of the slide.

Since this coupling 40 is arranged between driving motor 20 and slide 11, slide 11 and push rod 12 can integrally be made of plastics at low costs, as FIG. 10 makes clear.

Such an adjusting device is usually controlled via a manually adjustable operating switch, whereby after a rotation around an angle of 180 degree the electric motor is automatically switched off via an end position switch. For this purpose a switch disc has been fixed onto toothed wheel 26 up to now, on which switch disc several contact springs separately fastened to the housing are sliding. In an embodiment used as a control unit the operating switch is coupled with the slide or the push rod. Also for forming this operating switch separate fixed contacts have been attached within the housing. Because of the large number of separate contacts the assembly required a lot of time.

Figure 6:
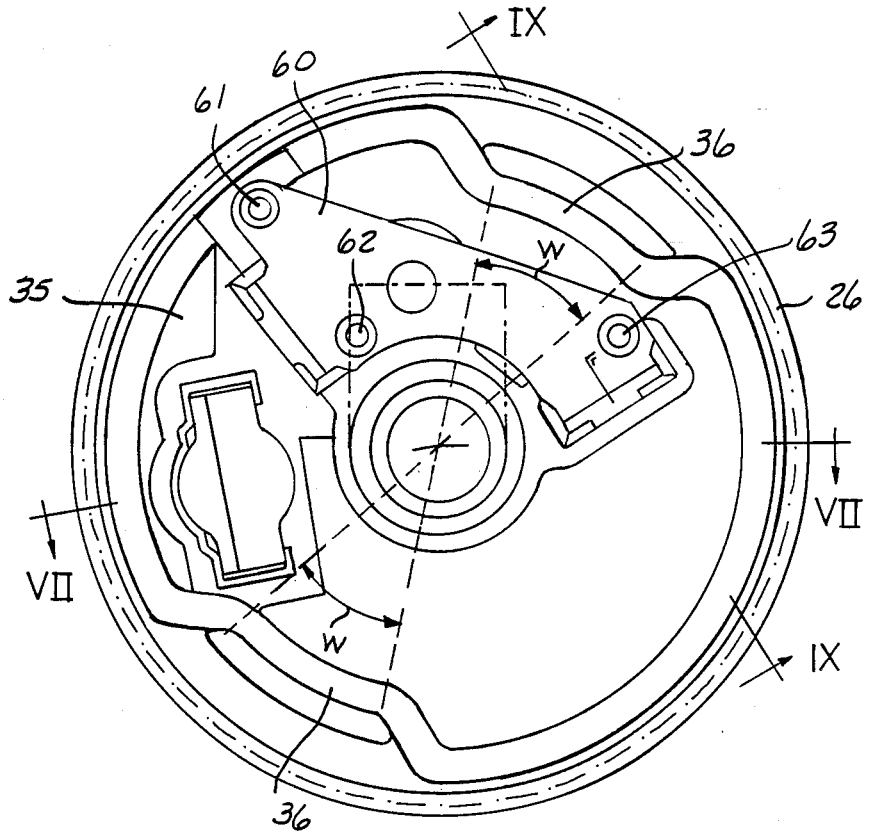
FIG. 6 is a view of the crank toothed wheel.
Figure 9:
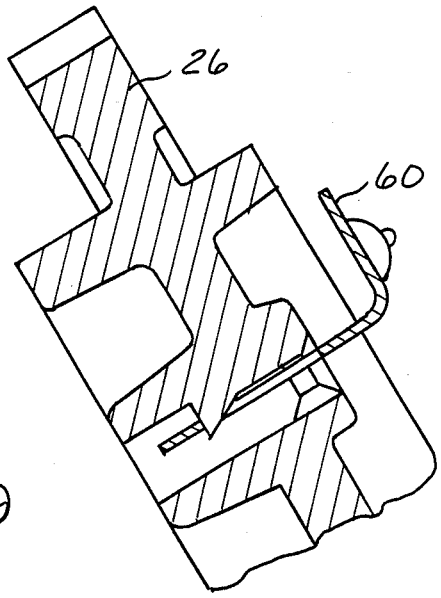
FIG. 9 is a partial section taken along the line IX—IX.
Figure 11:
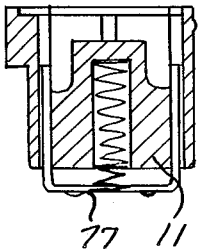
FIG. 11 is a section taken along the line XI—XI.
Figure 12:
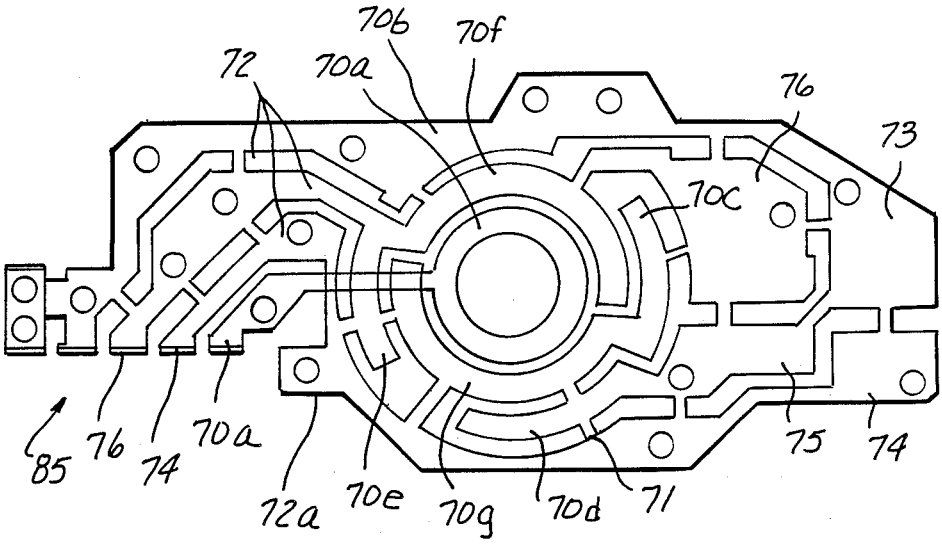
FIG. 12 is a view of a blank with contact segments.
Figure 13:
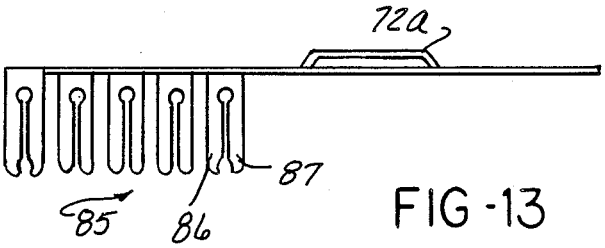
FIG. 13 is a partial section of the blank.

FIGS. 6, 7 and 9 show that a bridging contact 60 comprising three contact points 61, 62 and 63 are springily supported by toothed wheel 26. This bridging contact 60 acts in combination with contact segments 70 which are punched out of a blank and which at first, are at least partly connected via connecting webs 71 that are only separated after the assembly of the blank into the housing 10. Such a blank comprising several contact segments 70 and leads 72 and contact areas 73 to 76 integrally attached to said contact segments is represented by FIG. 12, whereby the section in FIG. 13 shows that separate leads 72a comprise a part in another area so that connections can be crossed without any danger of touching each other. The usage of such leads or contact segments punched out of a blank is, for instance, known from lamps of motor vehicles. Therefore no further explanations are needed. What metters in the present case, is that the bridging contact 60 is immediately springily integrated into toothed wheel 26. Thus this toothed wheel takes over another fuction. Furthermore it is important that contact areas 73 to 76 are also immediately punched out of this blank, which contact areas act in combination with another bridging contact 77 springily supported by slide 11 or by the part of push rod 12 which is inside the housing, as it is made obvious by FIGS. 10 and 11. Together with the bridging contact these contact areas form the operating switch which is designated by 78 in FIG. 14.

The concrete circuit according to FIG. 14 is not the object of the present invention. Therefore it should only be noted that shortly after the motor 20 has started running a self-holding circuit is actuated via a switching contact designated by 80 in FIG. 14 and that thus the motor enters one of its parking positions regardless of the switching postion of the operating switch. Switching contact 81 is part of the actual end position switch interrupting the motor circuit in the parking position. During an adjusting process the output terminal for other adjusting devices designated by A and E are connected in parallel via this switching contact and a further switching contact 82 so that the motors of these adjusting devices, too, safely enter their parking positions. In order to be able to check if this circuit according to FIG. 14 corresponds to the formation of the separate contact segments of FIG. 12, it is also pointed out that contact point 62 is continuously sliding on a contact segment 70*a* of a small radius. The contact point 61 is sliding on the contact segments 70*b* to 70*e* by means of the largest radius. After all, the contact point 63 is sliding on the contact segments 70*f* and 70*g* respectively.

FIG. 13 also makes evident that connecting clips 85 perpendicularly extending are mounted onto separate contact segments, leads or contact areas, which connecting clips 85 comprise two arms 86, 87 arranged at a certain distance from each other, between which supply leads or conducting wires of components are tightened without being soldered. FIG. 12 shows that several of these connecting clips 85 spatially assigned to each other are attached to the housing which the supply leads and the control signal leads as well as the connections leading to the electric motor being all combined in one cable 88 are fixed to. For the sake of security and for reducing the tension of the connections strip 89 as shown in FIGS. 22 and 23 is used.

FIG. 15 represents another embodiment not formed as a control unit. In comparison with FIG. 2 it can be seen that the principal construction is the same, that, however, an integrated operating switch is missing. The conducting wires of diodes 90 are fixed to connecting clips 85 arranged in pairs.

FIG. 15 and particularly FIGS. 17 and 18 refering to this embodiment show that at least one spring tongue 95 integrally connected with slide 11 is extending said slide, which spring tongue 95 is springily tensioned in the direction of a housing wall and is slidingly supported on said housing wall. The guiding of the slide shall be improved via this spring tongue 95, whereby spring tongue 95 evens out a clearance that cannot be avoided. With respect to the slide of the other embodiment this function is fulfilled by the springily supported bridging contact 77.

Also referring to this embodiment the conducting blank comprising separate contact segments is represented in FIGS. 19 and 20. The circuit diagram according to FIG. 20 is part of this modification. It shows that a self-holding circuit for electric motor 20 is again actuated via a switching contact 80. This self-holding circuit is actuated via one of the two diodes 90 so that one connection to this adjusting device is saved.

What is claimed is:

1. In a vehicle door locking device including a housing, an elongate lock actuating slide mounted for longitudinal reciprocatory movement along a fixed path within said housing between a locked position and are unlocked position, manually operable means for shifting said slide between said locked and unlocked position, crank means mounted in said housing at one side of said slide for rotation about a fixed axis normal to said fixed path and having a relatively small diameter pin means projecting toward said slide at fixed radial distance from said axis, a pair of stop members longitudinally and transversely offset from each other fixedly mounted on and projecting from said slide member into the path of rotation of said pin means about said axis, the longitudinal spacing of said stop means being less than the radial distance between said axis and said pin means and the transverse offset between said stop means being greater than the diameter of said pin means, unidirectional rotary drive means operable to drive said crank means about said axis between first and second parked positions 180° apart from each other wherein said slide may be manually shifted between said locked and unlocked positions without interference between said pin means and said stop means, said pin means being engageable with one of said stop means during rotation of said crank means between said parked positions to shift said slide between its locked and unlocked positions; the improvement wherein said drive means comprises a rotary member coupled to said crank means; brake means engageable with said rotary member to apply a predetermined braking force resisting rotation of said rotary member, and brake actuating means for applying said brake means when said crank means is within a predetermined rotative displacement from either of said parked positions and for releasing said brake means at all other rotary portions of said crank means.

2. The invention defined in claim 1 wherein said brake means comprises a brake block mounted in said housing for movement toward and away from said rotary member, and spring means biassing said block toward said rotary member, and said brake actuating means comprises cam means rotatively fixed to said crank means for shifting said block away from said rotary member when said crank means is rotatively displaced beyond said predetermined displacement from either of said parked positions.

3. The invention defined in claim 1 wherein said predetermined braking force is operable to prevent rotation from said crank means from either parked position unless the driving force exerted by said drive means exceedsd a force sufficient to assure a complete movement of said crank means from one parked position to the other parked position.

4. The invention defined in claim 1 wherein said drive means comprises a drive motor coupled to drive a worm gear constituting said rotary member, and said crank means includes a gear driven by said worm gear.

5. The invention defined in claim 1 wherein said pin means comprises a pin mounted in said crank means for axial movement toward and away from said one side of said slide, spring means biassing said pin toward said slide, the end of said pin adjacent said slide being of a rounded conical configuration and said stop means having complementarily inclined pin engaging surfaces.

* * * * *